US006400242B1

(12) United States Patent
Fasano et al.

(10) Patent No.: US 6,400,242 B1
(45) Date of Patent: Jun. 4, 2002

(54) HIGH CURRENT AUXILIARY SWITCH FOR A CIRCUIT BREAKER

(75) Inventors: Michael A. Fasano, Waterbury; Thomas R. J. Swift, Monroe, both of CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 09/684,995

(22) Filed: Oct. 10, 2000

(51) Int. Cl.[7] ..... H01H 75/00; H01H 77/00; H01H 83/00; H01H 27/10; H01H 3/00

(52) U.S. Cl. ..... 335/13; 335/6; 335/11; 200/18; 200/42.01

(58) Field of Search ..... 335/6, 11, 13, 335/126, 129, 130, 131, 132; 200/16 R, 16 A, 16 B, 16 C, 16 F, 18, 42.01, 240, 241, 242, 243, 245, 246, 342

(56) References Cited

U.S. PATENT DOCUMENTS 3,659,237 A * 4/1972 Wilsdon et al. ..... 335/191
4,760,226 A * 7/1988 Fasano ..... 200/303
5,990,771 A * 11/1999 Quentric ..... 335/126

* cited by examiner

*Primary Examiner*—Ramon M. Barrera
(74) *Attorney, Agent, or Firm*—McCormick, Paulding & Huber LLP

(57) ABSTRACT

An auxiliary switch for a circuit breaker of the split case type. The switch is capable of switching the rated interrupt current capacity of the breaker and is fitted in to the circuit breaker case so that the overall width is substantially equal to or less than the overall width of the circuit breaker. Several embodiments of the auxiliary switch disclose various features which contribute to increasing the interrupt current rating and/or down sizing the width of the auxiliary switch. Among them are: an early make, late break of the auxiliary contacts compared to the circuit breaker contacts; an inertia dampening fly wheel attached to the actuator of the switch to enhance the early make/late break feature; a wiping action between the moveable and stationary contacts of the auxiliary switch to clean off welding and debris deposited from arcing; dual auxiliary contacts to enhance the contact area with little impact on package size and width; and a positioning of the auxiliary actuator on the contact lever of the circuit breaker to prevent the spring forces acting on the actuator from affecting circuit breaker contact pressure.

14 Claims, 6 Drawing Sheets

HIGH CURRENT AUXILIARY SWITCH FOR A CIRCUIT BREAKER

FIELD OF THE INVENTION

The present invention relates generally to circuit breakers. More specifically, the present invention relates to an auxiliary switch for a circuit breaker which is capable of switching substantially the rated interrupt current of the circuit breaker.

BACKGROUND OF THE INVENTION

Control panel systems, having a variety of panel mounted circuit breakers mounted thereon, are often sold in both the United States and Europe to provide branch circuit protection or supplementary (equipment) protection. By way of example, circuit breakers are often mounted in theater lighting control panel systems to provide protection for branch circuits which supply electrical power to the various lights of a theater. Alternatively, circuit breakers can also be mounted in control panels to provide dedicated supplementary protection to equipment such as computers, power supplies or copying machines.

Circuit protection standards vary between the United States and Europe, and impose different performance requirements on the circuit breakers involved. For example, U.S. standards rarely allow the provision of a disconnect to the neutral (return) side of a circuit load, while European standards often require it. European standards for a neutral disconnect effectively requires the addition of another switch, capable of handling the rated interrupt current capacity of the circuit breaker, when connected in series with the circuit breaker and the load. Rated interrupt current, i.e., interrupting rating, is defined in article 100 of the 1996 edition of the National Electric Code, published by the National Fire Protection Association, Quincy, Mass., as: "the highest current at rated voltage that a device is intended to interrupt under standard test conditions". The interrupt current and the standard test conditions for a device, such as a circuit breaker, would typically be specified in an industry excepted standard, e.g., UL 1077, titled Standard For Supplementary Protectors For Use In Electrical Equipment, or UL489, titled Standard For Molded Case Circuit Breakers And Circuit Breaker Enclosures. Prior art attempts to modify existing U.S. circuit breakers to provide neutral side disconnects involved stacking a second pole up against the single pole circuit breaker, effectively doubling the width and size of such an assembly.

However, space is a premium in control panel systems. In the telecommunication industry, for example, telecommunication equipment designers can earn bonuses of up to $1000 for every square inch of panel space saved. Consequently, there is often very little panel space to accommodate the additional second pole for the circuit breakers without an expensive redesign of the system. This is especially critical when the additional requirements increase the overall package width, since the circuit breakers are often stacked side by side, leaving very little space in between for growth.

Auxiliary switches are often mounted to the bottom portions of circuit breakers to provide an extra set of switching contacts without a significant increase in overall package size or width. However, auxiliary switches are primarily used to indicate status of the circuit breaker, e.g., whether the circuit breaker is open or closed, and typically have current switching capacities which are much lower than the interrupt current capacity rating of the main breaker. The low power auxiliary switches are constructed of much smaller components and require much less space to actuate than the main contacts of the circuit breaker.

To construct an auxiliary switch capable of switching the rated interrupt current capacity of its associated circuit breaker with a minimum impact in overall package width is problematic for several reasons. For example, the contact gap spaces and spring forces for the auxiliary switch must increase, tending to increase the package size and width. Also, since the auxiliary contacts are mechanically actuated by the main breaker contacts, the increased spring forces from the auxiliary switch actuator acting on the main breaker contacts may significantly change the main breaker contact pressure. This can result in excessive arcing and premature circuit breaker contact wear.

Another significant factor which tends to make the auxiliary switch package grow is that the higher power requirements can result in greater arcing during make (make contact) or break (break contact) of the auxiliary contacts. This increases the possibility of welding the contacts together or leaving debris and carbon deposits on the contacts. This problem is often minimized in the main circuit breaker with a lateral wiping action designed between the movable and stationary contacts of the main breaker. The wiping action is used to clean the contacts and shear away any welds as the contacts make or break. That is, the moveable contacts of the main circuit breaker pivots on a moveable contact lever to make contact with the stationary contact. A generally kidney shaped slot at the pivot point of the movable contact lever is fundamental to this arcuate motion. This slot is easily elongated to provide for over travel in the lateral directions of the contacts relative to each other, which results in the wiping action.

However, auxiliary switch contacts are typically designed to have a substantially linear motion when bridging the contact gaps (bridge contacts), rather than the arcuate motion described above for the main breaker contacts. Problematically, the bridge contacts are not conducive to providing a wiping action in the lateral direction. The arcing problem can be compensated for by increasing the size of the auxiliary contacts and their associated contact gaps, but this tends to unduly increase the overall package size and width.

Accordingly, there is a need for an improved auxiliary switch for a circuit breaker, which is capable of switching the rated interrupt current capacity of the associated circuit breaker.

SUMMARY OF THE INVENTION

The present invention offers advantages and alternative over the prior art by providing an auxiliary switch for a circuit breaker capable of switching the rated interrupt current capacity of the breaker. The auxiliary switch/circuit breaker assembly can be used to provide neutral disconnects to an existing control panel system to meet European standards.

These and other advantages are accomplished in an exemplary embodiment of the invention by providing a circuit breaker assembly comprising a circuit breaker and an auxiliary switch. The circuit breaker has a predetermined rated interrupt current capacity, and includes a movable contact lever having a circuit breaker moveable contact disposed thereon. The contact lever has an open position and a closed position. The auxiliary switch includes a switch housing mounted in an opening defined by the circuit breaker. An auxiliary actuator is movably mounted within the switch housing and has an upper portion of the auxiliary actuator protruding into the opening of the circuit breaker from the switch housing. An auxiliary moveable contact member has an auxiliary moveable contact disposed thereon, the member is moveably mounted to the auxiliary actuator. A contact spring acts between the auxiliary actuator and the auxiliary moveable contact member. An auxiliary stationary contact is arranged in the switch housing for engagement with the auxiliary moveable contact. A return spring is disposed between the switch housing and auxiliary actuator urging the auxiliary stationary and moveable contacts apart. The auxiliary switch is adapted to switch substantially the rated interrupt current of the circuit breaker through the moveable and stationary auxiliary contacts when the moveable contact lever of the circuit breaker moves from the open position to the close position, thereby depressing the auxiliary actuator to have the auxiliary moveable contact make contact with the auxiliary stationary contact.

In an alternative embodiment of the invention the overall width of the auxiliary switch is substantially equal to or less than the overall width of the circuit breaker.

Several embodiments of the auxiliary switch disclose various features which contribute to increasing the interrupt current rating and/or down sizing the width of the auxiliary switch. Among them are:

- an early make, late break of the auxiliary contacts compared to the circuit breaker contacts;
- an inertia dampening fly wheel attached to the actuator of the switch to enhance the early make/late break feature;
- a wiping action between the moveable and stationary contacts of the auxiliary switch to clean off welding and debris deposited from arcing;
- dual auxiliary contacts to enhance the contact area with little impact on package size and width; and
- a positioning of the auxiliary actuator on the contact lever of the circuit breaker to prevent the spring forces acting on the actuator from affecting circuit breaker contact pressure.

DETAILED DESCRIPTION OF THE PREFERRED EMBODIMENTS

Figure 1:
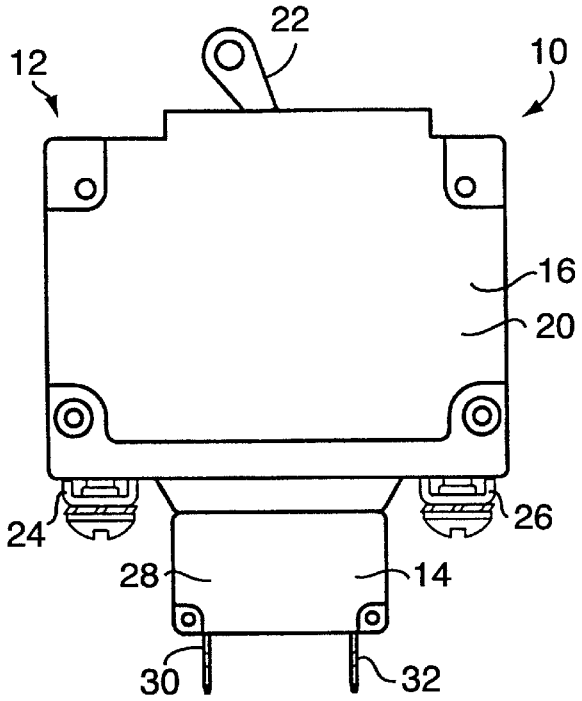
FIG. 1 is a side view of a circuit breaker assembly in accordance with the present invention.
Figure 2:
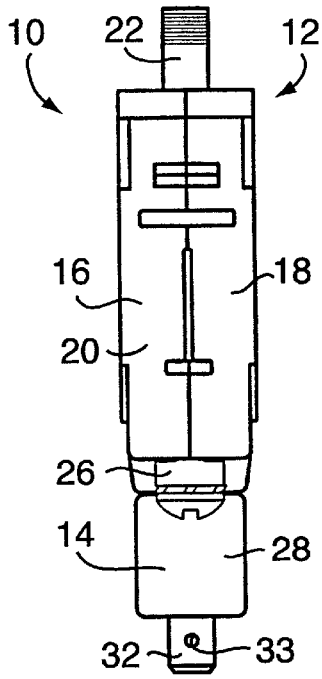
FIG. 2 is a side view of FIG. 1.

Referring to FIGS. 1 and 2, front and side views respectively, of an exemplary embodiment of a circuit breaker assembly in accordance with the present invention is shown generally at 10. The circuit breaker assembly 10 includes a circuit breaker 12 with an auxiliary switch 14 mounted thereon. Half shells 16 and 18 form a split case enclosure 20 which encloses the interior components of the circuit breaker 12. Toggle handle 22, extending out of the top of circuit breaker 12, is pivotally mounted to the interior of the split case 20 to provide manual actuation of the circuit breaker 12, and circuit breaker terminals 24 and 26, extending through the bottom of circuit breaker 20, provide electrical connection to load and source lines (not shown). The auxiliary switch 14 includes a switch housing 28 mounted in an opening defined by the circuit breaker 12, and has a pair of auxiliary terminals 30 and 32 extending straight through the bottom of switch housing 28. The auxiliary terminals include a center hole 33 through which a wire, e.g., a source line or load line, can be attached.

As will be discussed in greater detail hereinafter, the auxiliary switch 14 is adapted to switch substantially the rated interrupt current of circuit breaker 12 without substantially changing the overall package width of the circuit breaker assembly 10. That is the overall width of the auxiliary switch 14 is substantially equal to or less than the overall width of the circuit breaker 12.

Typically, the auxiliary switch 14 and circuit breaker 12 fall into a general industry classification of "Low Voltage" circuit protection devices, which have normal operation ratings that range up to 100 amps at 300 volts AC or 100 amps at 80 volts DC. In addition to the normal operation ratings, circuit protection devices are required to be rated for the maximum current they can safely interrupt under standard test conditions at their rated voltage. This rating is known as the interrupt current capacity of the circuit protection device. The auxiliary switch 14 is typically rated for use, in series with the circuit breaker, with an interrupt current capacity of 5000 amps at 120 volts AC, 3000 amps at 240 volts AC, and 5000 amps at 80 volts DC.

Comparatively, prior art auxiliary switches in these voltage ranges are not rated for handling substantially higher interrupt currents than the normal operation current ratings and are therefore limited to use for indicating circuit breaker status, e.g., on/off or make/break.

Though this embodiment describes a split case circuit breaker, the circuit beaker can be any switch that automatically interrupts an electric circuit under an infrequent abnormal condition, e.g., current overload.

Figure 3:
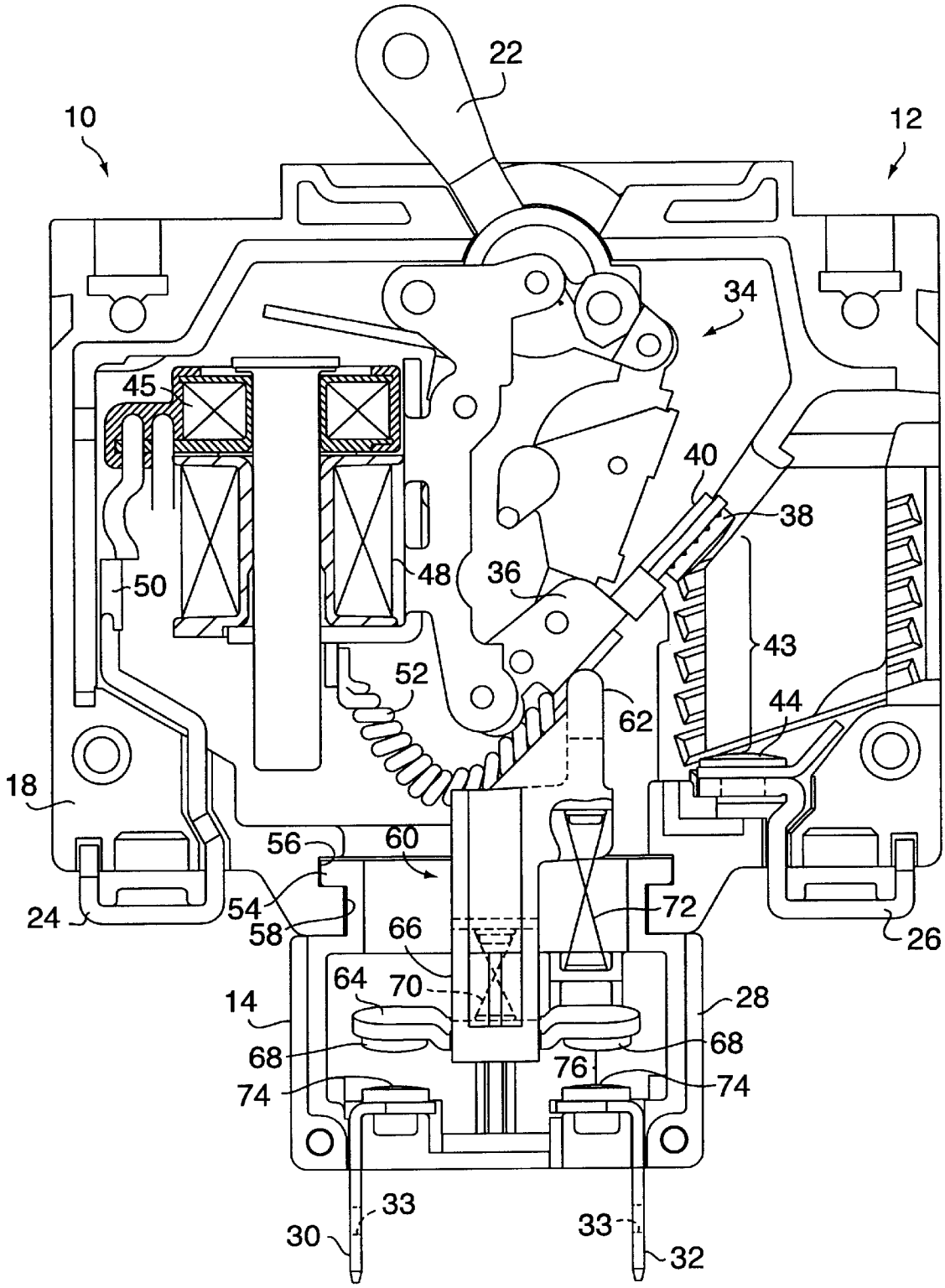
FIG. 3 is a perspective view of the interior of the circuit breaker assembly with the circuit breaker moveable contact lever in the open position.
Figure 4:
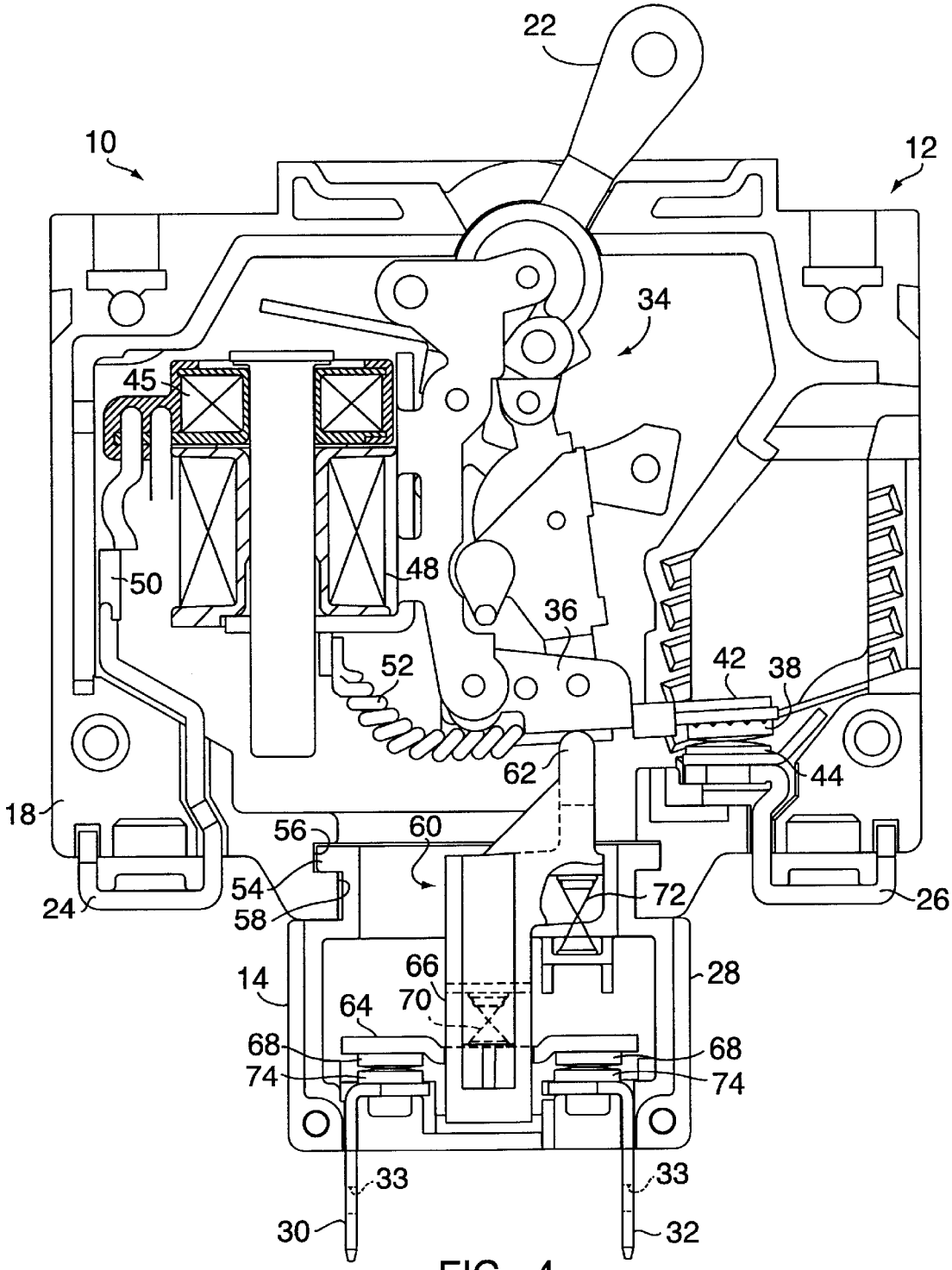
FIG. 4 is a perspective view of the interior of the circuit breaker assembly with the circuit breaker moveable contact lever in the closed position.

Referring to FIGS. 3 and 4, the circuit breaker 12 includes a collapsible linkage assembly 34 engaged between a moveable contact lever 36 and the handle 22 which is pivotally mounted to the circuit breaker enclosure 20. The moveable contact lever 36 includes a circuit breaker moveable contact 38 disposed thereon which traverses from an open position 40 to a closed position 42 across a predetermined first distance 43, to make electrical contact (make) with circuit breaker stationary contact 44. Typically, when the contact lever 36 is in the closed position, a source current will conduct through terminal 26 to the stationary contact 44. The current is conducted through the stationary contact 44, through the movable contact 38, to the movable contact lever 36. The movable contact lever 36 is connected to the current sensing electromagnetic coil 48 through lead 52. The coil 48 is connected through lead 50 to the terminal 24 and out to a load. When the current in the coil exceeds a predetermined rated current capacity, e.g. rated operational current or rated interrupt current, the coil will cause the circuit breaker to trip, thereby collapsing the linkage assemble 34, pivoting the moveable contact lever 36 from the closed position 42 to the open position 40 and breaking contact (break) between the moveable and stationary contacts 38 and 44 to open the circuit. An auxiliary coil 45 may be provided for allowing remote or relay opening of the contacts 42/44. The auxiliary coil 45 is preferably on a separate bobbin from the main coil 48 rather than simply supplied as an alternative to the usual circuit breaker configuration with a single main coil. See U.S. Pat. No. 4,982,174 for such an arrangement. In FIGS. 3 and 4, the auxiliary coil bobbin is made in two parts so as to surround the coil 45 completely. The arrangement assures that failure of the coil 45 will not interfere with normal circuit breaker operation.

The auxiliary switch housing 28, of the auxiliary switch 14, includes flanges 54 which slidably engages circuit breaker mounting grooves 56 to mount the housing 28 into opening 58 defined by the circuit breaker enclosure 20. The auxiliary switch 14 also includes an auxiliary actuator 60 slidably mounted within the switch housing 28. An upper portion 62 of the auxiliary actuator 60 protrudes into the opening 58 of the circuit breaker 12 from the switch housing 28. An auxiliary moveable contact member 64 extends laterally out of opposing sides of a hollow lower portion 66 of the auxiliary actuator 60 and has a pair of auxiliary moveable contacts 68 disposed thereon. The moveable contact member 64 is moveably mounted and retained by the hollow lower portion 66 of the auxiliary actuator 60. A contact spring 70 (shown in dotted lines) acts between the auxiliary actuator 60 and the auxiliary moveable contact member 64 to urge the moveable contact member 64 against the bottom of the auxiliary actuator 60. A return spring 72 is disposed between the switch housing 28 and the auxiliary actuator 60 urging the upper portion 62 of the auxiliary actuator 60 into engagement against the movable contact lever 36 of the circuit breaker 12. A pair of auxiliary stationary contacts 74 are arranged in the switch housing 28 for engagement with the auxiliary moveable contacts 68 and are spaced a second predetermined distance 76 therefrom. When the moveable contact lever 36 of the circuit breaker 12 moves from the open position 40 to the close position 42, the contact lever 36 depresses the auxiliary actuator 60 to have the auxiliary moveable contact 68 traverse the second predetermined distance 76 and make contact with the auxiliary stationary contact 74.

Typically, when the auxiliary switch 14 is used as a neutral disconnect for a protected load, the auxiliary contacts 68 and 74 of the auxiliary switch 14 will be wired on the neutral side of the load in series with the load and the circuit breaker contacts 38 and 44 of the circuit breaker 12. In this case, when the auxiliary contacts 68 and 74 are closed, load current will conduct from terminal 30, through one of the moveable and stationary contacts 68 and 74, across the moveable contact member 64, through the other moveable and stationary contacts 68 and 74, and out terminal 32 to the source. Since the auxiliary actuator 60 of the auxiliary switch 14 is mechanically actuated by circuit breaker contact lever 36, when the circuit breaker 12 trips the actuator switch 14 will also trip, thereby causing the auxiliary contacts 68 and 74 to separate and disconnect the neutral line from the load.

By utilizing the dual pair of moveable and stationary auxiliary contacts 68 and 74 rather than a single set of contacts, the contact surface area and gap size are effectively doubled without significantly affecting the overall width of the auxiliary switch 14. The dual contacts are therefor a contributing factor to the increased current capacity of the auxiliary switch 14.

Another factor that reduces arcing in the auxiliary switch 14 and enables the auxiliary switch 14 to switch substantially the rated interrupt current of the circuit breaker 12, is a late break, early make feature. That is, the predetermined second distance 76 through which the auxiliary moveable contacts 68 must traverse is designed to be less than the predetermined first distance 43 through which the circuit breaker moveable contact 38 must traverse. Consequently, the moveable and stationary contacts 68 and 74 of the auxiliary switch 14 will make earlier and break later, than the moveable and stationary contacts 38 and 44 of the circuit breaker 12. Therefore, most of the arcing occurs across the larger circuit breaker contacts when they make or break first, enabling the smaller auxiliary contacts to be reduced in size for the same interrupt current rating.

Though the circuit breaker moveable contact lever 36 is shown as a pivotally mounted moveable contact arm, other moveable contact lever embodiments are also considered within the scope of this invention. By way of example, the lever 36 may have a dual contact bridge configuration similar to that of the moveable contact member 64.

Though the auxiliary actuator 60 is shown in this embodiment as being slidably mounted within the switch housing 28, one skilled in the art would recognize that the auxiliary actuator 60 may be moveably mounted in other ways, e.g., pivotally mounted. Additionally, though the auxiliary actuator 60 is shown in this embodiment as making contact with the moveable contact lever 36 when it is in the open position 40, a gap may exist between the auxiliary actuator 60 and the moveable contact lever 36 when it is in this position 40. In that case, the gap will be closed as the moveable contact lever 36 moves from the open position 40 to the closed position 41 to contact and depress the auxiliary actuator 60.

Figure 5:
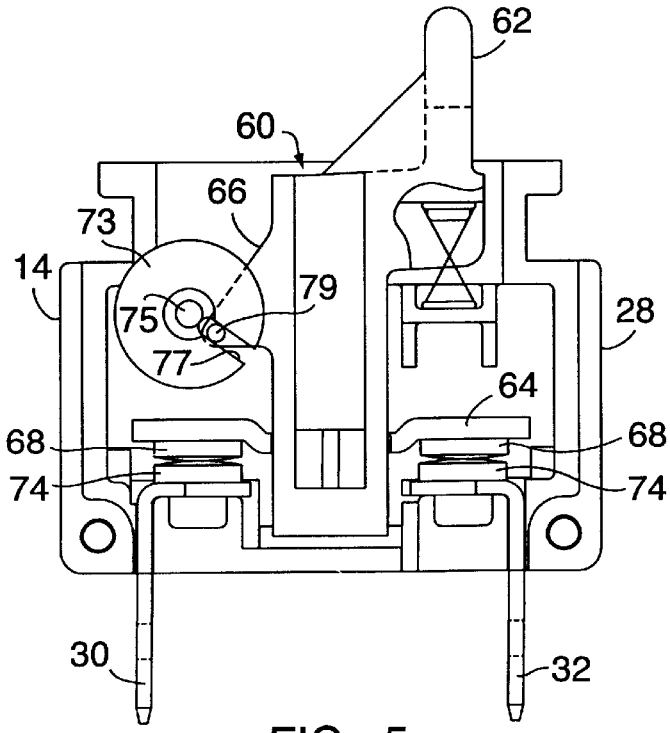
FIG. 5 is a perspective view of an embodiment of the auxiliary switch showing an inertia dampening fly wheel in accordance with the present invention.

Referring to FIG. 5, another embodiment of the auxiliary actuator switch 14 shows an enhancement to the early make, late break feature whereby an inertia dampening flywheel 73 is pivotally attached to the switch housing 28 via flywheel pivot axis 75. The flywheel has an engagement slot 77 slidably engaged to a mounting pin 79 located on the lower portion 66 of the auxiliary actuator 60.

The fly wheel 73 engaged with the auxiliary switch actuator 60 provides inertia dampening to the auxiliary switch 14 such that the moveable and stationary contacts 68 and 74 of the auxiliary switch 14 break later than the moveable and stationary contacts 38 and 44 of the circuit breaker 12. When the inertia dampening of the flywheel is combined with the early make, late break design discussed previously, the arcing across the auxiliary contacts 68 and 74 is further reduced, allowing the auxiliary switch 14 to be further down sized.

Figure 6:
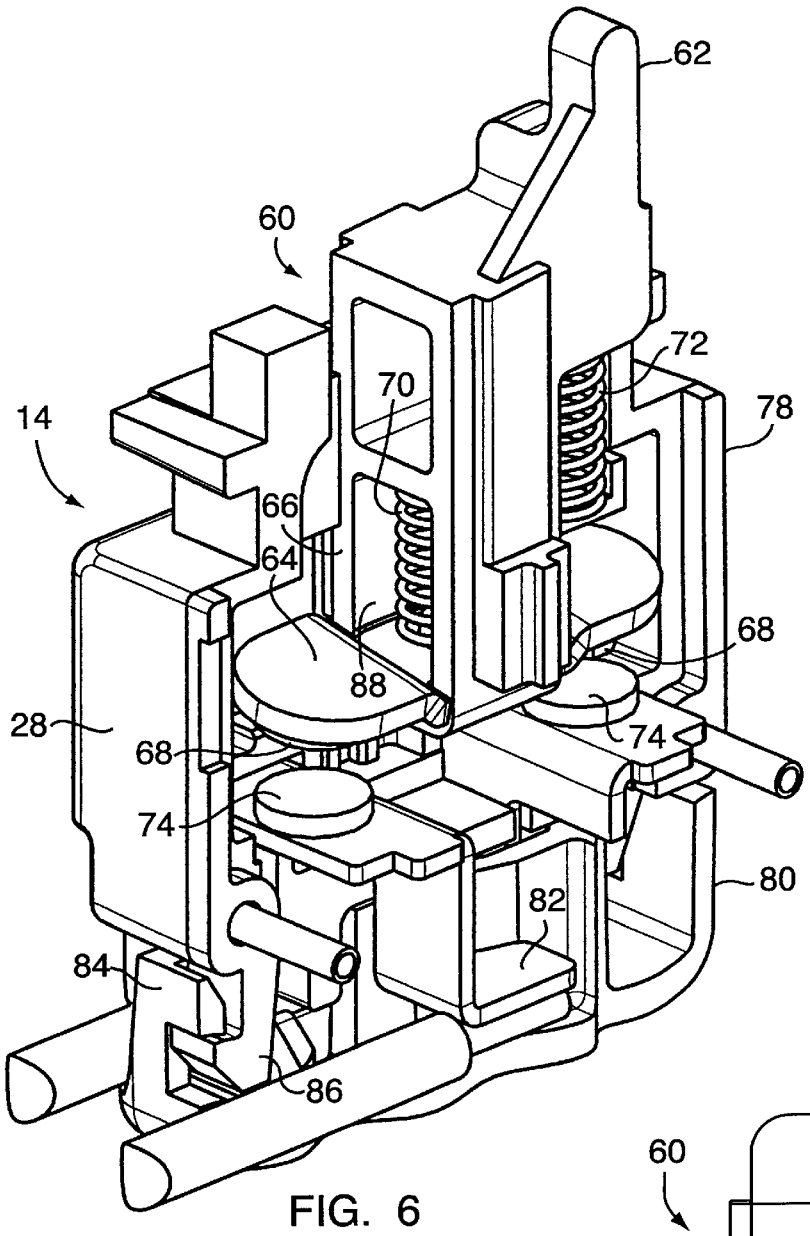
FIG. 6 is a perspective view of an embodiment of the auxiliary switch showing a canted moveable contact member in accordance with the present invention.
Figure 7:
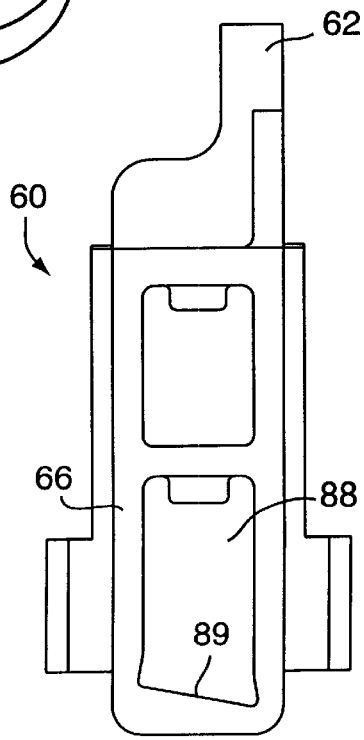
FIG. 7 is a side view of the actuator of the switch in FIG. 6.

Referring to FIGS. 6 and 7, an alternative embodiment of the auxiliary switch 14 is shown where case 28 further includes an upper portion 78 removeably attached to a lower portion 80. The lower portion 80 covers and protects right angle terminals 82 and has lower portion hooks 84 extending upwardly to removably engage with upper portion hooks 86 extending downwardly from the bottom of the upper portion 78 of case 28.

This embodiment also shows the auxiliary moveable contact member 64 canted (tilted) relative to the substantially horizontal stationary contacts 74 which enables a contact wiping action when the moveable and stationary contacts 68 and 74 make and break. The lower portion 66 of the auxiliary actuator 60 has a hollow section 88 with a canted bottom surface 89 which slidably retains the contact spring 70 and contact member 64. The contact spring 70 urges the contact member 64 flush against the canted surface 89 when the actuator 60 is fully extended, i.e., when the moveable contact lever 38 is in the open position 40.

Figure 8:
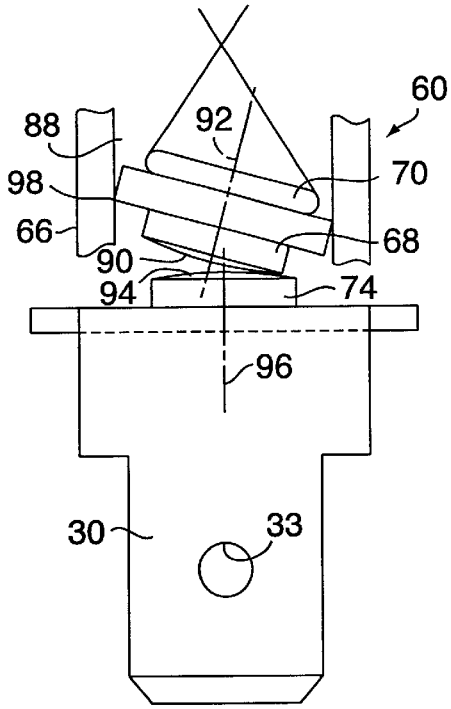
FIG. 8 is an enlarged view of the moveable and stationary contact of the auxiliary switch of FIG. 6 with their centerlines offset.
Figure 9:
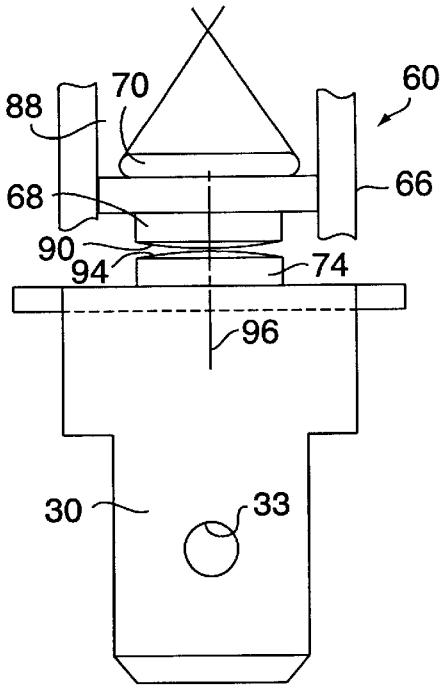
FIG. 9 is an enlarged view of the moveable and stationary contact of the auxiliary switch of FIG. 6 with their centerlines aligned.

Referring to FIGS. 8 and 9, a convex surface 90 is disposed on the auxiliary moveable contacts 68 having a centerline 92 substantially normal to the surface 90. Additionally, a convex surface 94 is disposed on the auxiliary stationary contacts 74 having a centerline 96 substantially normal to the surface 94, and facing the convex surface 90 of the auxiliary moveable contacts 68. When the moveable contact lever 36 pivots from the open position 40 to the closed position 42, the actuator 60 is depressed. The moveable and stationary contacts 68 and 74 move linearly toward each other until their convex surfaces 90 and 94 make contact with their centerlines 92 and 96 being offset. The pair of stationary contacts 74 then lift the moveable contact member 64 off of the canted surface 89 of the actuator 60 such that the contact spring 70 generates a force along the centerline 92 of the moveable contacts 68. Consequently, a reactionary force is generated along the centerline 96 of the stationary contact 74. This misalignment of forces creates a moment that rotates the moveable contact member 64. Since the contact member 64 is retained by the hollow section 88 of actuator 60, it is forced to pivot about a pivot point 98 urging the centerlines 92 and 96 of the contacts 68 and 74 substantially into alignment. This rotation causes a relative lateral motion between the moveable and stationary contacts 68 and 74, wiping the surfaces 90 and 94 clean of welds and debris caused by arcing on break. On break, the slanted surface 89 of the actuator 60 contacts one side of the moveable contact member 64 first, generating a twisting moment that will shear any contact welds caused by arcing on make. The wiping action enables the spring forces and contact surface areas to be downsized, and therefore is an additional factor in enabling the switch to keep a small package size and a high interrupt current rating.

Figure 10:
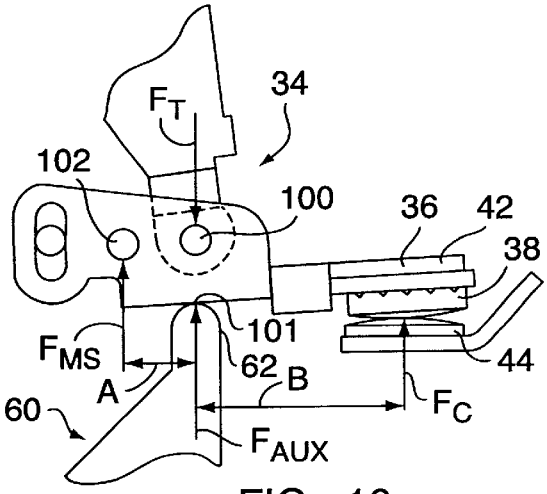
FIG. 10 is a force balance diagram on the moveable contact lever of the circuit breaker of FIG. 4 in the closed position.

Referring to FIG. 10, a force balance diagram on the moveable contact lever 36 in the closed position 42 is shown. A toggle compression force $F_T$ is generated by the collapsible linkage assembly 34 on the contact lever 36. The toggle compression force $F_T$ has a line of direction which passes through toggle attachment point 100 and fulcrum point 101 which is located on the moveable contact 38 side of the moveable contact lever 36. A main spring force $F_{MS}$ through the main spring pin 102 reacts to the toggle compression force $F_T$ to generate a moment $M_{MS}$ defined by the equation $M_{MS}=F_{MS}(A)$, where "A" is the distance between the line of direction of $F_{MS}$ and the fulcrum point 101. This moment $M_{MS}$ is reacted to by the moveable contact 38 on the stationary contact 44 to generate a predetermined contact pressure force $F_C$ and an equal and opposite contact pressure moment $M_C$. The contact pressure moment $M_C$ is defined by the equation $M_C=F_C(B)$ where "B" is the distance between the line of direction of $F_C$ and the fulcrum point 101. The upper portion 62 of the auxiliary actuator 60 is positioned at the fulcrum point 101 and generates an auxiliary actuator force $F_{AUX}$ which is substantially in line with the direction of the opposing toggle compression force $F_T$.

It is important to maintain the predetermined contact pressure $F_C$ between the moveable and stationary contacts 38 and 44 to insure proper circuit breaker 12 performance and to prevent premature wear on the contacts 38 and 44. By positioning the actuator 60 at the fulcrum point 101, the larger springs required to enable the auxiliary switch 14 to handle the higher interrupt current ratings of the circuit breaker 12 can be utilized without affecting the contact pressure $F_C$ or the performance of the circuit breaker 12.

Figure 11:
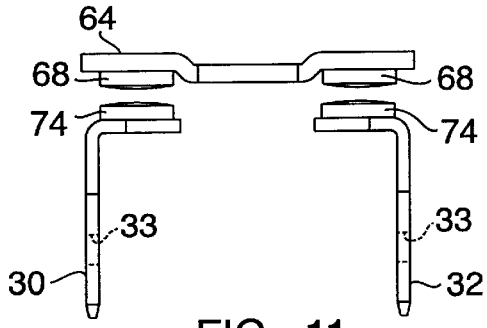
FIG. 11 is a schematic diagram of the auxiliary switch contacts having a single pole, single throw, double break arrangement.

Referring to FIG. 11, as is well known, the auxiliary switch contacts are discussed above as having a single pole, single throw, double break arrangement. However, it is also considered within the scope of this invention to have other contact arrangements as well. By way of example, a single pole, double throw, double break embodiment is shown in FIG. 12.

Figure 12:
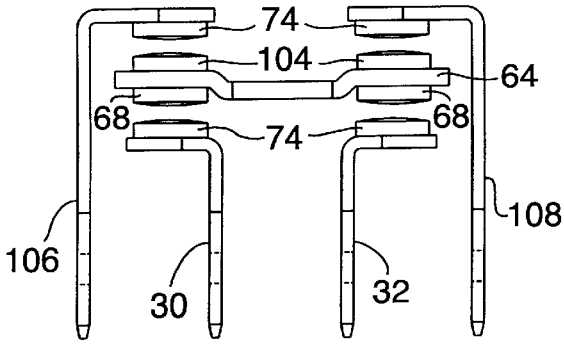
FIG. 12 is a schematic diagram of the auxiliary switch contacts having a single pole, double throw, double break arrangement.

Referring to FIG. 12, the contact lever 64 of the auxiliary switch 14 has an additional pair of moveable contacts 104 disposed on its opposing side. An additional pair of terminals 106 and 108 are connected to an additional pair of stationary contacts 110. The terminals 30 and 32 could be connected in one circuit, and the terminals 106 and 108 could be connected to a separate circuit. Alternatively, terminals 30 and 106 or terminals 32 and 108 could be tied together in the same circuit.

Figure 13:
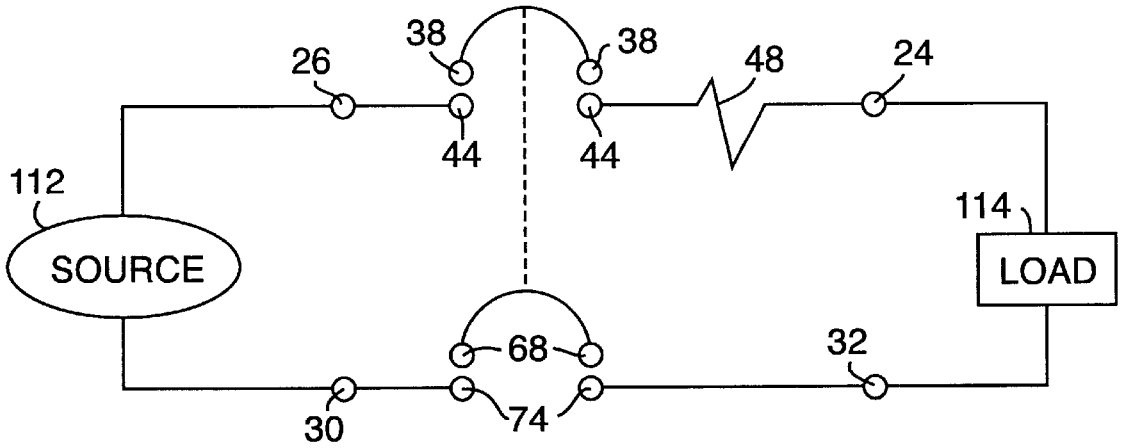
FIG. 13 is a wiring diagram of the auxiliary switch used as a neutral disconnect with the circuit breaker.

Referring to FIG. 13, a wiring diagram of the auxiliary switch used as a neutral disconnect is shown. The line side of the source 112 is connected to terminal 26 which is in series with the circuit breaker contacts 38 and 44, current sensing coil 48 and terminal 24 of the circuit breaker. The load line is connected in series to load 114. The return side of the load is connected to auxiliary terminal 32 which is in series with auxiliary contacts 74 and 68, and auxiliary terminal 30. Auxiliary terminal 30 is in turn connected to the return side of the source 112 to complete the circuit. The full load current must conduct through both the circuit breaker contacts 38 and 44 on the line side of the circuit, and the auxiliary contacts 68 and 74 on the load side of the circuit. Since the auxiliary contacts 68 and 74 are mechanically tied to the circuit breaker contacts 38 and 44, when the circuit breaker 12 disconnects the line side, the auxiliary switch 14 will disconnect the neutral side.

Figure 14:
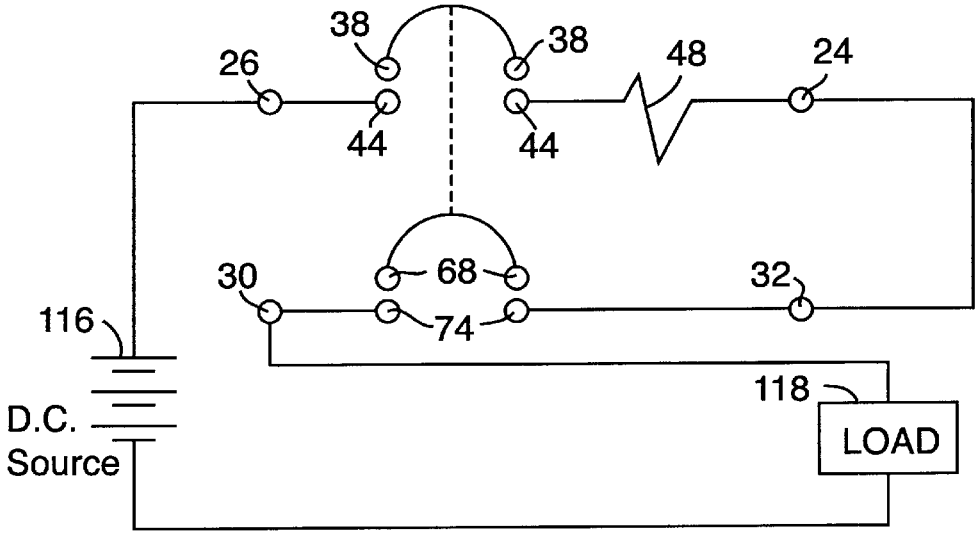
FIG. 14 is a wiring diagram of the auxiliary switch wired in series with the circuit breaker to increase interrupt capability of the circuit breaker in a DC circuit.

Referring to FIG. 14, a wiring diagram of the auxiliary switch 14 used in series with the circuit breaker 12 in a DC circuit is shown. In this embodiment the circuit breaker contacts 38 and 44 are in series connection with the auxiliary contacts 68 and 74 on the high side of a DC circuit between a DC source 116 and a load 118. By connecting the auxiliary switch in this fashion, the DC interrupt capacity of the circuit breaker can be increased.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A circuit breaker assembly comprising:

a circuit breaker having a predetermined rated interrupt current capacity, the circuit breaker including a movable contact lever having a circuit breaker moveable contact disposed thereon, the contact lever having an open position and a closed position; and an auxiliary switch including, a switch housing (28) mounted in an opening defined by the circuit breaker, an auxiliary actuator moveably mounted within the switch housing, an upper portion of the auxiliary actuator protruding into the opening of the circuit breaker from the switch housing, an auxiliary moveable contact member having an auxiliary moveable contact disposed thereon, the member moveably mounted to the auxiliary actuator, a contact spring acting between the auxiliary actuator and the auxiliary moveable contact member, an auxiliary stationary contact arranged in the switch housing for engagement with the auxiliary moveable contact, and a return spring disposed between the switch housing and the auxiliary actuator urging the auxiliary stationary and moveable contacts apart, wherein the auxiliary switch is adapted to switch substantially the rated interrupt current of the circuit breaker through the moveable and stationary auxiliary contacts when the moveable contact lever of the circuit breaker moves from the open position to the close position, thereby depressing the auxiliary actuator to have the auxiliary moveable contact make contact with the auxiliary stationary contact.

2. The circuit breaker assembly of claim 1 wherein the circuit breaker includes a stationary contact for cooperation with the moveable contact and wherein when the stationary and moveable contacts of the circuit breaker are connected in series with the stationary and moveable contacts of the auxiliary switch, the auxiliary switch is adapted to switch substantially the rated interrupt current of the circuit breaker.

3. The circuit breaker assembly of claim 1 wherein overall width of the auxiliary switch is substantially equal to or less than overall width of the circuit breaker.

4. The circuit breaker assembly of claim 1 wherein the moveable auxiliary contact moves substantially linearly toward the stationary auxiliary contact before making contact, and moves laterally across the auxiliary contact after making contact to provide a wiping action.

5. The circuit breaker assembly of claim 4 further comprising:

a convex surface disposed on the auxiliary moveable contact having a centerline substantially normal to the surface;

a convex surface disposed on the auxiliary stationary contact having a centerline substantially normal to the surface, the convex surface of the auxiliary stationary contact facing the convex surface of the auxiliary moveable contact; and a lower portion of the auxiliary actuator having a hollow section with a canted bottom surface which slidably retains the contact spring and contact member such that the contact spring urges the contact member flush against the canted surface when the actuator is fully extended;

wherein, when the actuator is depressed, the convex surfaces of the moveable and stationary auxiliary contacts make initial contact with their centerlines being offset, the stationary contact then lifting the moveable contact member off of the canted surface of the actuator such that the contact spring urges the centerlines of the contacts substantially into alignment for final contact.

6. The circuit breaker assembly of claim 1 further comprising:

a stationary contact for the circuit breaker;

a predetermined first distance between the moveable and stationary contacts of the circuit breaker, through which the circuit breaker moveable contact traverses when making and breaking with the circuit breaker stationary contact; and a predetermined second distance between the moveable and stationary contacts of the auxiliary switch, through which the auxiliary moveable contact traverses when making and breaking with the auxiliary stationary contact, the predetermined second distance being less than the predetermined first distance;

wherein, the moveable and stationary contacts of the auxiliary switch make earlier, and break later, than the moveable and stationary contacts of the circuit breaker.

7. The circuit breaker assembly of claim 1 further comprising:

at least a second moveable contact disposed on the auxiliary moveable contact member; and at least a second stationary contact disposed on the auxiliary stationary contact, whereby the first and second auxiliary moveable contacts make and break with the first and second auxiliary stationary contacts respectively.

8. The circuit breaker assembly of claim 1 wherein the auxiliary switch further comprises a fly wheel engaged with the auxiliary switch actuator to provide inertia dampening to the auxiliary switch such that the moveable and stationary contacts of the auxiliary switch break later than the moveable and stationary contacts of the circuit breaker.

9. The circuit breaker assembly of claim 1 wherein the circuit breaker includes a collapsible linkage assembly engaged with the moveable contact lever, wherein, when the moveable contact lever is in the closed position and the auxiliary actuator is positioned on the contact lever such that the direction of force applied by the auxiliary actuator on the contact lever is substantially in line with the direction of opposing force applied by the collapsible linkage assembly on the contact lever.

10. The circuit breaker assembly of claim 1 wherein the circuit breaker further comprises a split case circuit breaker; and wherein said opening is defined in part by one of the split cases and in part by the other of said split cases.

11. An auxiliary switch in a circuit breaker having a predetermined rated interrupt current capacity, the circuit breaker including a movable contact lever having a circuit breaker moveable contact disposed thereon, the contact lever having an open position and a closed position, the circuit breaker also including an opening for receiving an auxiliary switch, the auxiliary switch comprising;

a switch housing adapted to be mounted in a circuit breaker opening;

an auxiliary actuator moveably mounted within the switch housing and having an upper portion arranged to protrude into an opening of a circuit breaker from the switch housing;

an auxiliary moveable contact member having an auxiliary moveable contact disposed thereon, the member moveably mounted to the auxiliary actuator;

a contact spring acting between the auxiliary actuator and the auxiliary moveable contact member;

an auxiliary stationary contact arranged in the switch housing for engagement with the auxiliary moveable contact; and a return spring disposed between the switch housing and the auxiliary actuator urging the auxiliary stationary and auxiliary moveable contacts apart; wherein the auxiliary switch switches substantially the rated interrupt current of a circuit breaker through the auxiliary moveable and auxiliary stationary contacts; and wherein the auxiliary actuator moves in response to movement of the moveable contact of the circuit breaker from an open to a closed position to bring the auxiliary moveable contact into contact with the auxiliary stationary contact;

wherein the moveable auxiliary contact moves toward the stationary auxiliary contact before making contact, and moves laterally across the auxiliary contact after making contact to provide a wiping action.

12. The auxiliary switch of claim 11 wherein the auxiliary switch further comprises a fly wheel engaged with the auxiliary switch actuator to provide inertia dampening to the auxiliary switch such that the moveable and stationary contacts of the auxiliary switch break later than moveable and stationary contacts of the circuit breaker.

13. The auxiliary switch of claim 11 further comprising:

a convex surface disposed on the auxiliary moveable contact having a centerline substantially normal to the surface;

a convex surface disposed on the auxiliary stationary contact having a centerline substantially normal to the surface, the convex surface of the auxiliary stationary contact facing the convex surface of the auxiliary moveable contact; and a lower portion of the auxiliary actuator having a hollow section with a canted bottom surface which slidably retains the contact spring and contact member such that the contact spring urges the contact member flush against the canted surface when the actuator is fully extended;

wherein, when the actuator is depressed, the convex surfaces of the moveable and stationary auxiliary contacts make contact with their centerlines being offset, the stationary contact then lifting the moveable contact member off of the canted surface of the actuator such that the contact spring urges the centerlines of the contacts substantially into alignment.

14. In a circuit breaker assembly having an auxiliary switch mounted to a circuit breaker, the circuit breaker having a predetermined rated interrupt current capacity and including a movable contact lever having a circuit breaker moveable contact disposed thereon, the contact lever having an open position and a closed position, the circuit breaker also including an opening for receiving the auxiliary switch, the auxiliary switch comprising:

a switch housing mounted in the circuit breaker opening;

an auxiliary actuator moveably mounted within the switch housing and having an upper portion arranged to protrude into the opening of the circuit breaker from the switch housing;

an auxiliary moveable contact member having an auxiliary moveable contact disposed thereon, the member moveably mounted to the auxiliary actuator;

a contact spring acting between the auxiliary actuator and the auxiliary moveable contact member;

an auxiliary stationary contact arranged in the switch housing for engagement with the auxiliary moveable contact; and a return spring disposed between the switch housing and the auxiliary actuator urging the auxiliary stationary and auxiliary moveable contacts apart; wherein the auxiliary switch switches substantially the rated interrupt current of the circuit breaker through the auxiliary moveable and auxiliary stationary contacts; and wherein the auxiliary actuator moves in response to movement of the movable contact of the circuit breaker from an open to a closed position to bring the auxiliary moveable contact into contact with the auxiliary stationary contact.

* * * * *